United States Patent [19]

Itoh

[11] Patent Number: 4,903,568

[45] Date of Patent: Feb. 27, 1990

[54] TREMOLO DEVICE FOR A GUITAR

[75] Inventor: Hiroshi Itoh, Ichikawa, Japan

[73] Assignee: Meister Technology Co., Ltd., Tokyo, Japan

[21] Appl. No.: 305,349

[22] Filed: Feb. 2, 1989

[51] Int. Cl.[4] ..... G10D 3/00

[52] U.S. Cl. ..... 84/313

[58] Field of Search ..... 84/297 R, 299, 312 R, 84/313

[56] References Cited

U.S. PATENT DOCUMENTS

| | | | |
|---|---|---|---|
| 2,741,146 | 4/1956 | Fender | 84/313 |
| 4,383,466 | 5/1983 | Shibuya | 84/313 |
| 4,643,070 | 2/1987 | Petrillo | 84/313 |

FOREIGN PATENT DOCUMENTS

| | | | |
|---|---|---|---|
| 3520843 | 12/1986 | Fed. Rep. of Germany | 84/313 |

*Primary Examiner*—L. T. Hix
*Assistant Examiner*—Brian W. Brown
*Attorney, Agent, or Firm*—Finnegan, Henderson, Farabow, Garrett & Dunner

[57] ABSTRACT

A tremolo device for a guitar which includes a flat plate pivotably mounted about a fulcrum on a guitar body, a bar secured to the flat plate to receive and anchor strings of the guitar, at least one tension spring for exerting pressure against the flat plate and the bar in one rotating direction, against the tension of the guitar strings, a tremolo arm screwed into the flat plate to oscillate the flat plate and the bar to thereby produce a tremolo effect, a stabilizing plate provided on the bar to stabilize the initial position of the flat plate and the bar, and an abutting mechanism provided on the guitar body to support the flat plate and the bar through the stabilizing plate. The stabilizing plate has a dead point on the periphery thereof, and when the abutting mechanism comes into contact with that dead point, the flat plate and the bar can be most stably supported by the abutting mechanism.

9 Claims, 5 Drawing Sheets

TREMOLO DEVICE FOR A GUITAR

BACKGROUND OF THE INVENTION

1. Field of the Invention

The present invention relates to a tremolo device for a guitar, and more particularly, it relates to a device enabling a precise return to an initial tuning of the strings of the guitar after the tremolo device has been used.

2. Description of the Related Art

A guitar, for example, an electric guitar, equipped with a tremolo device which is manually moved to produce a tremolo effect on musical tones obtained by, for example, plucking the strings, is well-known and widely used. Known conventional tremolo devices include a synchronized device fitted to guitars made by the Fender Company (U.S. Pat. No. 2,741,146), a "Bigsby" device fitted to guitars made by the Gibson Company, and a "Vibramute" device fitted to guitars made by the Mosrite Company, and these tremolo devices have basically similar constructions.

Namely, these devices are provided with springs having a tension almost the same as the total tension of the strings of the guitar, and while an equilibrium is maintained between the tension of the springs and the total tension of the strings, the tones of the strings of the guitar are raised or lowered by moving a rod member, i.e., a tremolo arm, upward and downward in relation to a guitar body, to thus rotate the tremolo device about one fulcrum on the guitar body and thereby vary the tension of the guitar strings.

In the conventional tremolo devices mentioned above, however, a problem arises in that the whole of the device is always in a "floating" condition around one fulcrum, while maintaining an equilibrium between the tension of the springs and the tension of the strings.

In an ideal tremolo device, after the force applied to the tremolo arm is released, the tones raised or lowered by the device are returned to the exact initial tuning of the strings of the guitar, in which the equilibrium between the tension of the springs and the total tension of the strings is maintained. In practice, however, since the whole device is in a floating condition as mentioned above, deviations in the tones may occur which cannot be compensated by the restoring force derived from the tensions of the springs or strings, and thus the guitar will be out of tune when returned to the normal condition, i.e., when the tremolo device is inactivated.

SUMMARY OF THE INVENTION

An object of the present invention is to solve the above mentioned problem by providing a tremolo device for a guitar by which it is possible to return to the exact initial tuning of strings of the guitar after using the tremolo device.

The above object is achieved, according to the present invention, by providing a tremolo device for a guitar comprising:

(1) a base plate means including a flat plate pivotably mounted about a fulcrum on a guitar body, and a bar secured to said flat plate, said bar extending from said flat plate into said guitar body and being adapted to receive and anchor strings of said guitar;

(2) a spring means including at least one tension spring, said tension spring having one end engaged with said guitar body and the other end engaged with said bar, to thereby urge said base plate means in a direction of rotation opposite to a rotating force applied to said base plate means in an another direction of rotation due to a tension of said guitar strings.

(3) a tremolo arm extending from and manually engageable with said base plate means, to oscillate said base plate means to thereby vary a tension on said guitar strings, which variation of the tension on said guitar strings produces a tremolo effect; and (4) a stabilizing means for stabilizing said base plate means at a desired position where an initial tuning of said guitar strings can be obtained, and enabling a return to the exact initial tuning of said guitar strings after said tremolo arm has been oscillated.

In the present invention, said stabilizing means comprises a stabilizer in the form of a plate provided on said base plate means (hereinafter referred to as a stabilizing plate), the stabilizing plate having a dead point on the periphery thereof, and abutting means provided on said guitar body and adapted to come into contact with said periphery of the stabilizing plate, said abutting means supporting said base plate means through the intermediary of said stabilizing plate in the most stable condition when said abutting means is at said dead point.

DESCRIPTION OF THE PREFERRED EMBODIMENTS

Figure 1:
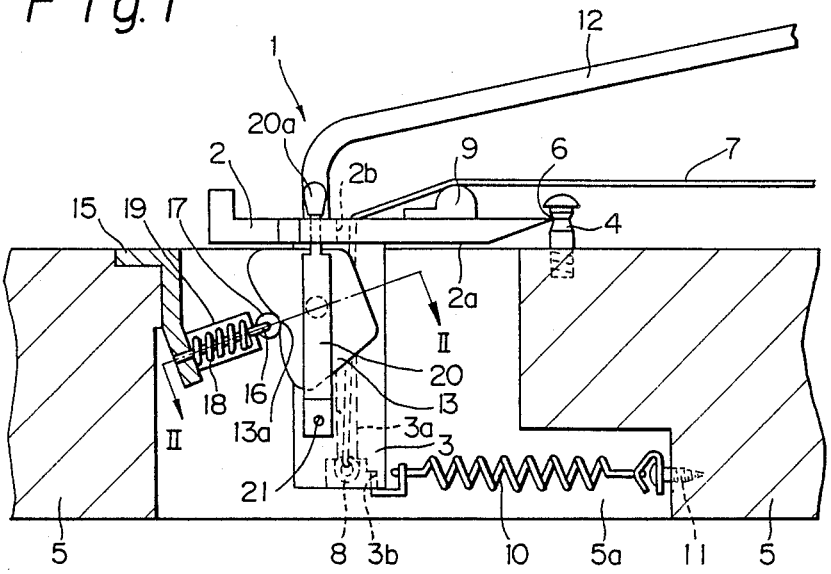
FIG. 1 is a partial longitudinal view of a guitar, showing a tremolo device in an inactivated condition at which an initial tuning of the guitar strings can be carried out, according to a first embodiment of the present invention, and taken along the line I—I of FIG. 2.

Referring to FIGS. 1 to 5, reference numeral 1 designates a tremolo device for a guitar in accordance with the first embodiment of the present invention. As shown in FIG. 1, the tremolo device 1 includes a flat plate 2 and a bar 3 secured to a lower surface 2*a* of the plate 2. The flat plate 2 has a knife-edge shaped front end, which comes into contact with V-shape peripheral grooves of screws 4 screwed into a guitar body 5, to provide a fulcrum 6 about which the flat plate 2 is pivotably mounted. The bar 3 extends downward into a hole 5*a* in the guitar body 5.

Reference numeral 7 designates strings of the guitar, the extremity of each string 7 being provided with an anchor element 8 seated in an elongated portion of a corresponding bore 3*a* formed in the bar 3. Each string 7 is then passed over a corresponding string saddle 9 through a corresponding hole 2*b* formed in the flat plate 2, and the other extremity of each string 7 is fixed to a tuning peg in a guitar head, not shown in the figures.

The bar 3 is provided with recesses 3*b* at the lower extremity thereof, and a plurality of tension springs 10 are engaged with one end in the recesses 3*b*. The other ends of the tension springs 10 are connected to the guitar body 5 by screws 11 screwed therein. Note, the plurality of tension springs 10 may be replaced by one tension spring. The tension springs 10 impart a force to and rotate the bar 3 and the flat plate 2 in a counter-clockwise direction as seen in FIG. 1 about the fulcrum 6, against another rotating force in the opposite direction, i.e., clockwise as seen in FIG. 1, derived from the total tension of the strings 7. Namely, when these rotating forces are balanced, the flat plate 2 and the bar 3 are maintained in a desired position as shown in FIG. 1, and thus an initial tuning of the guitar can be carried out.

Reference numeral 12 designates a tremolo arm. The tremolo arm 12 is screwed into the flat plate 2 and extends upwardly therefrom. The tremolo arm 12 is manually engageable to oscillate the flat plate 2 and the bar 3 about the fulcrum 6, to thereby vary the tension of the guitar strings 7, and thus produce a tremolo effect while raising or lowering the tone of the guitar strings.

Figure 2:
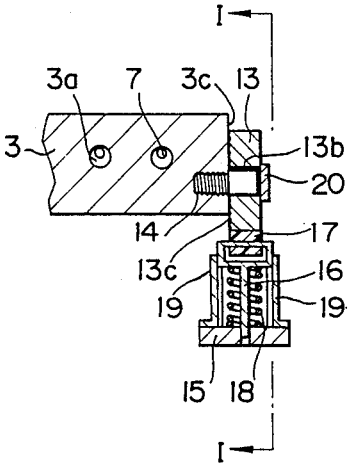
FIG. 2 is a partial sectional view taken along the line II—II of FIG. 1.

In the above-described construction of the tremolo device 1, according to the present invention, a means is provided for stabilizing an initial position of the flat plate 2 and the bar 3, which position is set before playing the guitar, and providing the initial tuning of the guitar strings 7 as shown in FIG. 1. The stabilizing means includes a stabilizing plate 13 rotatably mounted on a side surface 3*c* of the bar 3 and having a concave dead point 13*a* on the periphery thereof. The stabilizing plate 13 is provided at the approximate center thereof with a hole 13*b* through which a screw 14 is passed and screwed into the bar 3. The bore of the hole 13*b* is larger than the outer diameter of screw 14, to allow the stabilizing plate 13 to rotate about the screw 14. In addition, when the screw 14 is screwed in, a length of a portion thereof protruding from the side surface 3*c* is shorter than the thickness of the stabilizing plate 13, as shown in FIG. 2.

The stabilizing means also includes a mechanism which abuts against the periphery of, to impart a force to, the stabilizing plate 13, and comprises a mount 15 fixed to the guitar body 5, a slider 16 slidably mounted on the mount 15, a roller 17 rotatably attached to an end of the slider 16 to come into contact with the periphery of the stabilizing plate 13, a compression spring 18 arranged between the roller 17 and the mount 15 to press the slider 16 against the stabilizing plate 13, and two guide rails 19 facing each other and mounted on the mount 15 to support the slider 16 while allowing a linear sliding movement thereof. Furthermore, each of the guide rails 19 faceing each other and is provided with a groove with which the slider 16 is engaged. Note, the pressure on the stabilizing plate 13 is preferably directed toward the fulcrum 6, to exert a very slight effect on the equilibrium between the rotating force applied to the flat plate 2 and the bar 3 due to the springs 10, and the rotating force due to the guitar strings 7.

Figure 3:
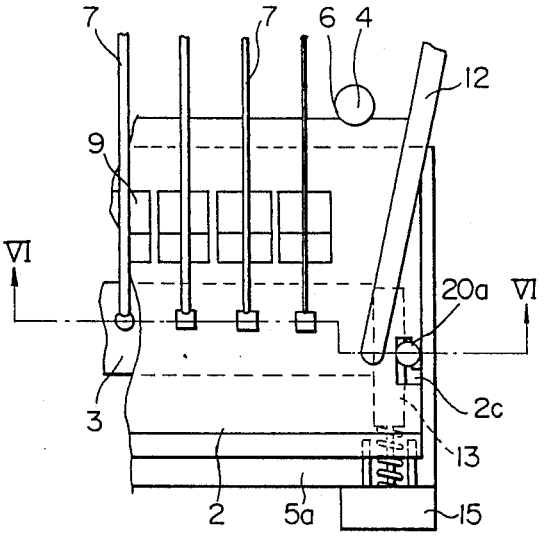
FIG. 3 is a partial plan view of the tremolo device shown in FIG. 1.

Furthermore, according to this embodiment, the tremolo device 1 includes a means for fixing the stabilizing plate 13 to the bar 3, by pressing the plate 13 against the side surface 3*c* of the bar 3, after the initial tuning of the guitar strings 7 is completed. The fixing means comprises a plate spring 20 having one end thereof fixed to the bar 3 by a screw 21, and an other end provided with a knob 20*a* protruding from the flat plate 2. The flat plate 2 is provided with an opening 2*c* with which the other end of the plate spring 20 is selectively engaged or disengaged. As shown in FIG. 3, the opening 2*c* is "L" shaped and has an open end through which the plate spring 20 is passed. Note, to firmly fix the stabilizing plate 13 to the bar 3, both the side surface 3*c* of the bar 3 and a side surface 13*c* of the stabilizing plate 13 preferably have a roughness sufficient to increase the coefficient of friction therebetween.

The method of using of the above mentioned tremolo device 1 and the operations thereof are as follows:

Before playing the guitar, the tones of the strings 7 are adjusted to an initial tuning by turning the pegs located in the guitar head. At this time, as shown in FIG. 4B, the end of the plate spring 20 is disengaged from the opening 2*c* of the flat plate 2, so that the stabilizing plate 13 is not pressed against the bar 3 by the plate spring 20. In this condition, the stabilizing plate 13 is rotatably mounted with respect to the bar 3, i.e., during tuning of the guitar, the stabilizing plate 13 is maintained in a state in which the roller 17 is on the concave dead point 13*a*, and the flat plate 2 and the bar 3 are rotated.

Figure 4A:
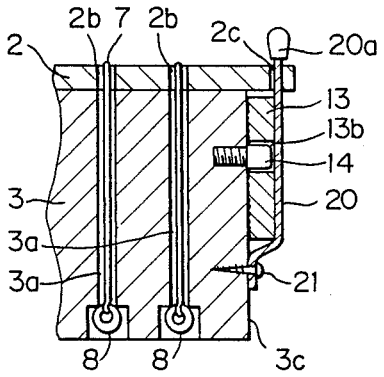
FIG. 4A is a partial sectional view taken along the line VI—VI of FIG. 3 and showing a stabilizing plate fixed onto the bar by a plate spring.
Figure 4B:
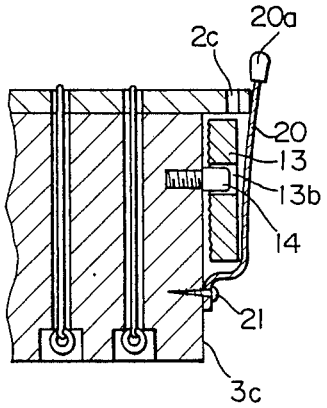
FIG. 4B is a partial sectional view similar to FIG. 4A, and showing the stabilizing plate in a free state, in which it is not fixed to the bar, for the initial tuning of the guitar strings.

When the initial tuning of the guitar is completed, the other end of plate spring 20 is engaged, using the knob 20*a*, with the opening 2*c* of the flat plate 2 as shown in FIG. 4A, and consequently, the plate spring 20 presses the stabilizing plate 13 onto the side surface 3*c* of the bar 3, and thus the plate 13 is firmly fixed to the bar 3 due to the aforementioned roughness of the side surfaces 3*c* and 13*c*. Note, when the guitar is played without using the tremolo device of this embodiment, the tremolo device 1 is in the state shown in FIG. 1. In this state, since the roller 17 comes into contact with the concave dead point 13*a*, the abutting mechanism stably supports the flat plate 2 and the bar 3 through the intermediary of the stabilizing plate 13 fixed to the bar 3.

Next, to produce a tremolo effect, the tremolo arm 12 is moved upward or downward in relation to the guitar body 5, in the same way as a conventional tremolo device. For example, when lowering the tone of guitar, the tremolo arm 12 is moved downward toward the guitar body 5 as shown in FIG. 5.

Figure 5:
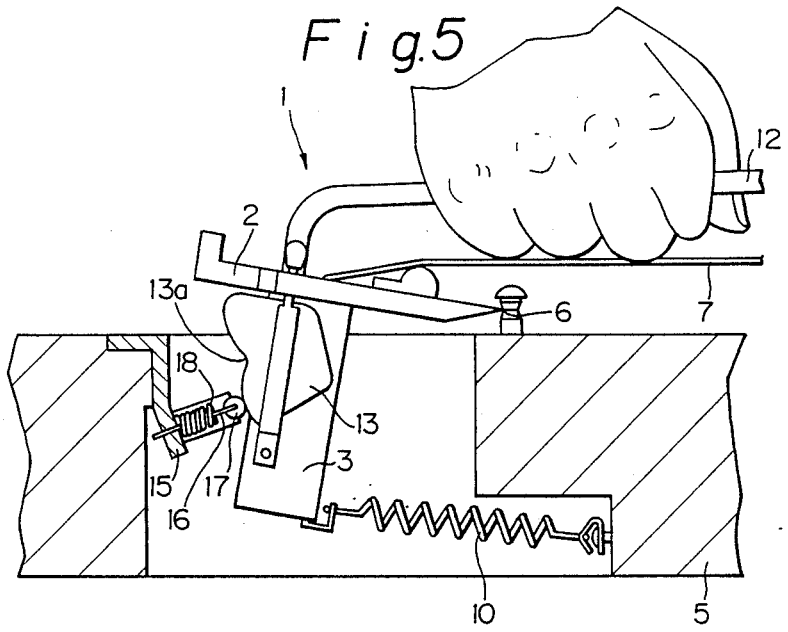
FIG. 5 is a longitudinal view similar to FIG. 1, in which the tremolo device is activated to lower the tones of the strings of the guitar.

In FIG. 5, the flat plate 2 and the bar 3 of the tremolo device 1 are rotated in the clockwise direction about the fulcrum 6. In this state, the tension of the strings 7 is reduced in comparison with the tension shown in FIG.

1, and thus the tone of the guitar strings is lowered. In addition, since the stabilizing plate 13 has been fixed to the bar 3, the roller 17 is not on the concave dead point 13*a* but is in contact with other peripheral convex portions of the stabilizing plate 13, and a pressure higher than that of FIG. 1 is applied to the plate 13.

When the use of the tremolo device 1 is to be finished and playing without the tremolo effect is to be resumed, it is necessary only to release the tremolo arm 12, whereby the tremolo device 1 is returned to the position shown in FIG. 1 by the equilibrium of rotating forces derived from the tensions of the guitar strings 7 and the springs 10, and then by the operation of the stabilizing means of the present invention. Namely, in the state shown in FIG. 5, since the abutting mechanism is engaged with the stabilizing plate 13 in an unstable condition, when returning to the initial tuning, the mechanism not only returns the tremolo device to the initial position, but also engages the stabilizing plate 13 in the most stable condition, i.e., engages with the concave dead point 13*a* of the stabilizing plate 13, and therefore, it is possible to return to the exact initial tuning after using the tremolo device.

Note that, according to this embodiment, since the periphery of the stabilizing plate 13 is formed in such a manner that the concave dead point 13*a* thereof is on a continuous curved line, the tremolo effect can be produced smoothly without vibration from the tremolo arm 12 when activating the tremolo device.

Figure 6:
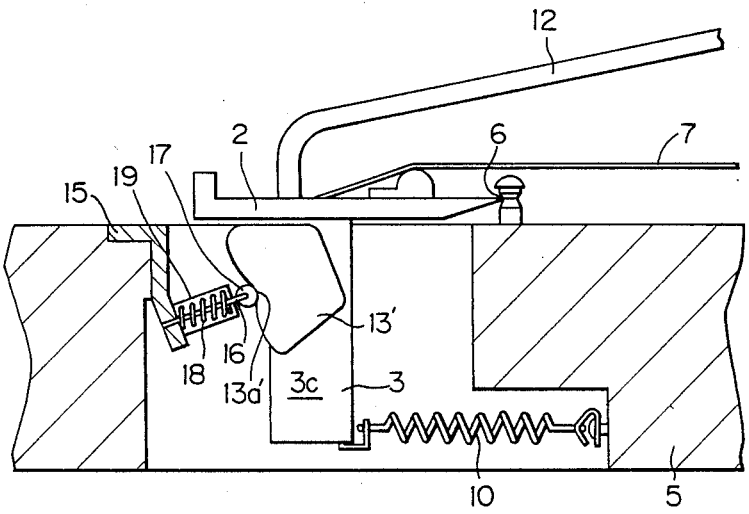
FIG. 6 is a partial longitudinal view similar to the first embodiment, in which the stabilizing plate is secured by, for example, brazing, to the bar, showing the tremolo device in an inactivated condition according to a second embodiment of the present invention.

FIG. 6 shows the second embodiment of the present invention.

Note, in FIG. 6, elements similar to those of the first embodiment are indicated by the same reference numerals and elements corresponding to those of the first embodiment are indicated by the same reference numerals suffixed with a prime.

According to this embodiment, there is provided a stabilizing plate 13' secured to the side surface 3*c* of the bar 3, as the means for stabilizing the initial tuning of the guitar, but no means is provided for fixing the stabilizing plate, such as the plate spring 20 in the first embodiment. Namely, in this embodiment, when the initial tuning of the strings 7 is completed, the roller 17 must be always located on the concave dead point 13*a'* of the stabilizing plate 13' fixed to the bar 3. This condition may be satisfied by setting the pressure derived from the compression spring 18 onto the stabilizing plate 13' at a considerably higher level than the pressure in the first embodiment, and by specifying the guitar strings 7 to be used. The operation of this tremolo device is substantially the same as that of the tremolo device 1 of the first embodiment.

FIGS. 7 to 10 show other embodiments of the present invention, including various modifications of the stabilizing means of the previous embodiments. Note, in these figures also, elements similar to those of the previous embodiments are indicated by the same reference numerals.

Figure 7:
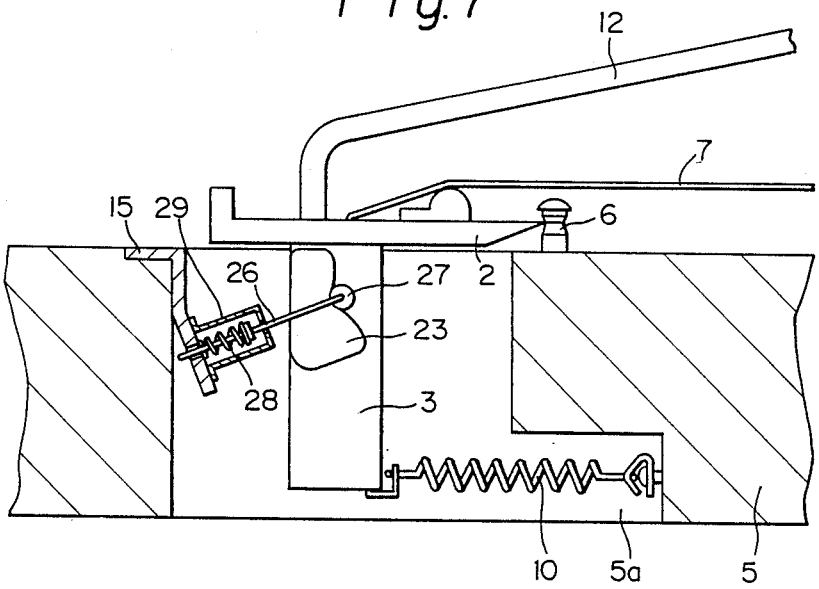
FIG. 7 is a partial longitudinal view of a guitar, showing the tremolo device in an inactivated condition according to a third embodiment of the present invention.

According to the third embodiment shown in FIG. 7, there is provided a stabilizing plate 23 having an outer profile different from that of the stabilizing plate 13 or 13' of the previous embodiments, and a tension spring 28 pulling a lever 26 and a roller 27 inward to thereby engage the roller 27 with the outer periphery of the stabilizing plate 23. Similar to the previous embodiments, the stabilizing plate 24 is provided with a concave dead point 23*a* on the outer periphery thereof, and thus when the roller 27 is on the concave dead point 23*a*, the flat plate 2 and the bar 3 are supported, through the intermediary of the stabilizing plate 23, in the most stable condition. Reference numeral 29 designates a guide supporting the lever 26, to allow a linear movement thereof. Note, in this embodiment, the stabilizing plate 23 is not rotatably mounted but is secured to the bar 3 in the same way as in the second embodiment. Nevertheless, it is also possible to mount the stabilizing plate 23 rotatably on the bar 3 and to provide the plate fixing means to fix the plate 23 to the bar 3 after obtaining the initial tuning. The operation of this tremolo device is also substantially the same as that of the tremolo device of the previous embodiments.

Figure 8:
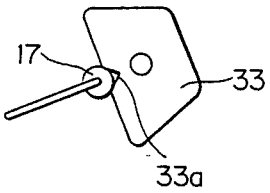
FIG. 8 is a view showing a modification of the stabilizing means according to a fourth embodiment of the present invention.

Referring to the fourth embodiment shown in FIG. 8, a stabilizing plate 33 is provided with a V-shaped groove 33*a* on the periphery thereof. The groove 33*a* corresponds to the concave dead point of the previous embodiments, and therefore, when the roller 17 is engaged with the groove 33*a*, the tremolo device (not shown) is supported thereby, through the intermediary of the stabilizing plate 33, in the most stable condition. In this embodiment, when use of the tremolo device is finished and normal playing is resumed, a slight shock may be felt due to the engagement with the V-shaped groove 33*a*, and thus a physical indication is given that the guitar has returned to the initial tuning.

Figure 9:
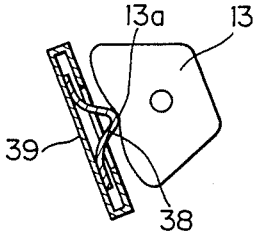
FIG. 9 is a view showing another modification of the stabilizing means according to a fifth embodiment of the present invention.

Referring to the fifth embodiment shown in FIG. 9, as the mechanism for abutting with the periphery of the stabilizing plate 13, there is provided a convex plate spring 38 biased toward the periphery of the plate 13, and a case 39 for housing the plate 38 therein. The case 39 may be mounted on the mount 15 (not shown; see FIG. 1) or directly on the guitar body.

Figure 10:
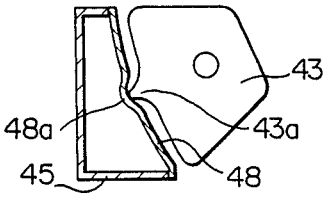
FIG. 10 is a view showing another modification of the stabilizing means according to a sixth embodiment of the present invention.

According to the sixth embodiment shown in FIG. 10, a stabilizing plate 43 is provided with a protruding portion 43*a* at a periphery thereof, in contact with an elastic sliding plate 48 mounted on a box type of mount 45 fixed to the guitar body (not shown). The elastic sliding plate 48 has a depression 48*a* on the sliding surface thereof, with which the protruding portion 43*a* is engaged when playing the guitar in the normal mode without the tremolo effect. That is, in the normal mode, the position of the tremolo device carrying the stabilizing plate 43 can be stabilized by a concave-convex engagement of the protruding portion 43*a* as the dead point, and the depression 48 as the abutting mechanism.

Figure 11:
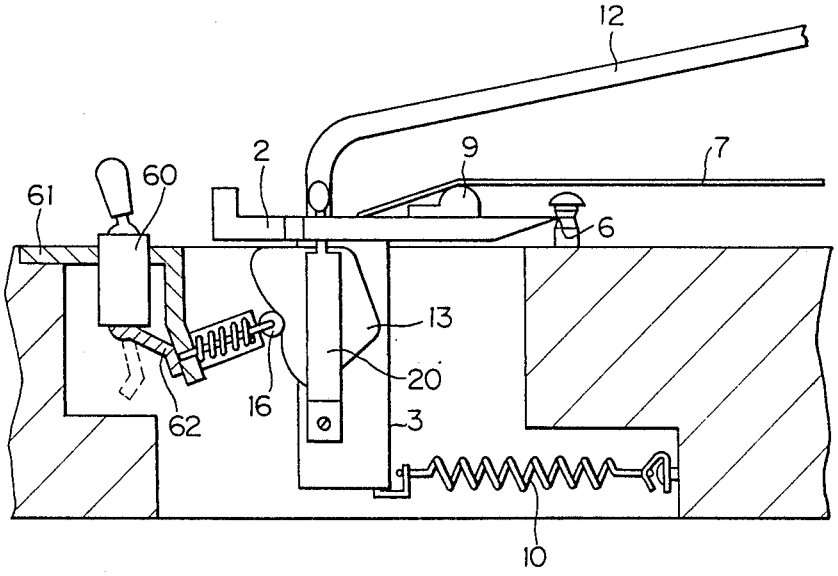
FIG. 11 is a partial longitudinal view of a guitar similar to FIG. 1, and showing a tremolo device which further comprises a mechanism for locking the stabilizing plate to prevent rotational movement of the tremolo device, according to a seventh embodiment of the present invention.

FIG. 11 shows the seventh embodiment of the present invention, in which the tremolo device further comprises a locking mechanism for preventing a pivotal movement of the tremolo device, i.e., rotation of the flat plate and the bar. Note, also in this embodiment, the same elements as those of the first embodiment are indicated by the same reference numerals.

The locking mechanism comprises a toggle switch 60 attached to a mount 61, and a movable member 62 activated by the toggle switch 60 to selectively assume either the position shown by a solid line, or the position shown by a broken line. The operation of the locking mechanism is as follows:

When the tremolo effect is not required, the toggle switch 60 is operated to move the movable member 62 to the position shown by the solid line and prevent movement of the slider 16, i.e., the tremolo device is locked to prevent pivotal movement. Therefore, in the normal mode, when various techniques such as "presto-playing" or "mute-playing" are used, in which the hand is placed on the flat plate 2, or "choking", if the tremolo device is locked as mentioned above, the tremolo device will not rotate about the fulcrum 6, and thus the guitar will remain in tune regardless of the playing technique used. Furthermore, if one or more guitar strings 7 break during playing, the equilibrium of the remaining strings will not be lost because the tremolo device is locked.

When the tremolo effect is required, the toggle switch 60 is operated to move the movable member 62 to the position shown by the broken line, to allow a sliding movement of the slider 16, and the tremolo device is unlocked. In this state, the operation is substantially the same as that of the first embodiment.

It will be understood by those skilled in the art that the foregoing description is of preferred embodiments of the disclosed tremolo device, and that various changes and modifications may be made to the present invention without departing from the spirit thereof. For example, although the stabilizing means in the first embodiment stabilizes the flat plate and the bar so that the tremolo device is in a state of equilibrium between the rotating force derived from the tension of springs and another rotating force derived from the tension of the guitar strings, the stabilizing means of the invention may be applied to stabilize the flat plate and the bar in another position where the tremolo device is in an unbalanced state which can be obtained by carrying out the initial tuning while the tremolo arm is intentionally moved up and down. Note, in this case, preferably the pressure of the abutting mechanism on the stabilizing plate is preset at a level high enough to overcome the lack of equilibrium between the above rotating forces, or that the engagement of the abutting mechanism with the dead point of the stabilizing plate is further stabilized by sharpening the concave outer profile including the dead point thereof.

Furthermore, the shape of the stabilizing plate may be formed suitably in such a manner that when the tremolo effect is produced, a vague feeling of bodily discomfort will not occur. Again, to suit various tastes, or to cope with different kinds of strings, the tremolo device may be constructed in such a manner that the stabilizing plate is exchangeable or that the pressure of the abutting means can be varied as desired.

In the first embodiment, although the means for fixing the stabilizing plate to the bar comprise the plate spring and so on, any fixing mechanism that can fix the stabilizing plate to the bar can be used.

In the embodiments, although the roller is disclosed as the element coming into contact with the stabilizing plate, a solid lubricant made of a high-molecular resin such as Teflon (trade mark), silicon, etc., or a sliding member such as a metal impregnated with oil, may be used as the element.

Further, in the previous embodiments, although the stabilizing plate is constructed as an element separate from but secured to the bar, the bar may be integrally provided with a part corresponding to the stabilizing plate, whereby the bar also has the function of the stabilizing plate.

As mentioned hereinabove, according to the present invention, by providing the stabilizing means for stabilizing the base plate means, i.e., the flat plate and the bar in the initial position, a tremolo device can be provided which enables a return to the exact initial tuning without bringing the guitar out of tune, even after the device has been activated.

I claim:

1. A tremolo device for a guitar comprising:

(1) base plate means including a flat plate pivotably mounted about a fulcrum on a guitar body, and a bar secured to said flat plate, said bar extending from said flat plate into said guitar body and said base plate means being adapted to receive and anchor strings of said guitar;

(2) spring means including at least one tension spring, said tension spring having one end engaged with said guitar body and another end engaged with said bar to thereby urge said base plate means in a direction of rotation opposite to a rotating force applied to said base plate means in an another direction of rotation due to a tension of said guitar strings;

(3) a tremolo arm extending from and manually engageable with said base plate means to oscillate said base plate means to thereby vary a tension applied to said strings, whereby a tremolo effect is produced; and (4) stabilizing means for stabilizing said base plate means at a desired position where an initial tuning of said guitar strings can be obtained, to thereby enable a return to the exact initial tuning of said guitar strings after said tremolo arm has been oscillated, said stabilizing means comprising a stabilizing plate provided on said bar, said stabilizing plate having a dead point on the periphery thereof, and abutting means provided on said guitar body and adapted to come into contact with said periphery of stabilizing plate, whereby when said abutting means is on said dead point, said abutting means stably supports said base plate means through the intermediary of said stabilizing plate.

2. A tremolo device according to claim 1, wherein said stabilizing means further comprises means for fixing said stabilizing plate to said bar, and wherein said stabilizing plate is rotatably mounted on said bar.

3. A tremolo device according to claim 2, wherein said means for fixing said stabilizing plate to said bar is a plate spring which presses said stabilizing plate against said bar and wherein contacting surfaces of said bar and said stabilizing plate have a roughness sufficient to increase a coefficient of friction therebetween.

4. A tremolo device according to claim 1, wherein said stabilizing plate is secured to said bar.

5. A tremolo device according to claim 1, wherein said abutting means is brought into contact with said stabilizing plate by an urging force directed toward said fulcrum.

6. A tremolo device according to claim 1, wherein said periphery of said stabilizing plate is constituted by a continuous curved line, and said dead point is a concave portion of said curved line.

7. A tremolo device according to claim 1, wherein said dead point is a V-shaped groove formed on said periphery of said stabilizing plate.

8. A tremolo device according to claim 1, wherein said dead point is a protruding portion formed on said periphery of said stabilizing plate, and said abutting means is a depression formed on a sliding surface of an elastic sliding plate.

9. A tremolo device according to claim 1, further comprising a mechanism for locking said pivotal movement of the tremolo device, wherein said mechanism comprises a toggle switch, and a movable member activated by said toggle switch to prevent movement of said abutting means corresponding to said pivotal movement of the tremolo device.

* * * * *